US005415150A

United States Patent [19]

Dallas

[11] Patent Number: 5,415,150

[45] Date of Patent: May 16, 1995

[54] APPARATUS FOR PROJECTING A BALL

[75] Inventor: W. Gordon Dallas, Ashland, Ohio

[73] Assignees: Dallas Tech Tools, Inc., Ashland; Whiteside Mfg., Delaware, both of Ohio

[21] Appl. No.: 116,613

[22] Filed: Sep. 7, 1993

[51] Int. Cl.[6] ..... A63B 69/00

[52] U.S. Cl. ..... 124/50; 124/16; 124/45; 273/26 R

[58] Field of Search ..... 124/16, 50, 49, 45, 124/84, 24.1; 273/26 D, 26 R, 29 A

[56] References Cited

U.S. PATENT DOCUMENTS

| | | | |
|---|---|---|---|
| 3,128,752 | 4/1964 | Andersen | 124/16 |
| 3,213,842 | 10/1965 | Laney | 124/41.1 |
| 3,406,674 | 10/1968 | Zone | 124/41.1 |
| 3,777,733 | 12/1973 | Mitchell | 124/16 |
| 3,804,071 | 4/1974 | Winrow . | |
| 3,989,027 | 11/1976 | Kahelin . | |
| 4,122,822 | 10/1978 | Scheiwiller . | |
| 4,254,755 | 3/1981 | Morgan et al. . | |
| 4,345,577 | 8/1982 | Andersson . | |
| 4,365,612 | 12/1982 | Defosse . | |
| 4,523,573 | 6/1985 | Defosse et al. . | |
| 4,646,709 | 3/1987 | Kholin . | |
| 4,676,504 | 6/1987 | Ponza . | |
| 4,714,069 | 12/1987 | Ulrich . | |

OTHER PUBLICATIONS

1992 Catalog page from Volleyball One ® Sales Company, Division of Volleyball Plus! Incorporated, 15392 Assembly Lane, Suite A, Huntington Beach, Calif. 92649.

*Primary Examiner*—Randolph A. Reese
*Assistant Examiner*—Anthony Knight
*Attorney, Agent, or Firm*—Renner, Kenner, Greive, Bobak, Taylor & Weber

[57] ABSTRACT

A machine (10) for projecting a ball, such as a volleyball (B), includes a longitudinally extending, pivotally mounted impact arm (27). A power spring (32) is attached to one end of the arm (27). A ramp (41) is provided on the arm (27) and is mounted angularly with respect to the longitudinal direction of the arm (27). A motor (34) has a rotating shaft (37) which carries a crank arm (38) having a roller (40) at the end. The roller (40) first engages the ramp (41) to extend the spring (32) and pivot the arm (27) and then disengages the ramp (41) so that the arm (27) pivots the other direction under the influence of the spring (32). A pivotally mounted cradle (25) holds a ball (B) in the path of the arm (27) so that the other end of the arm (27) strikes the ball (B). A shock absorbing system (47) engages the arm (27) after the ball (B) has been struck. A supply of balls (B) may be held in a magazine (18), and an arm (43) can be moved to engage a ball (B) to move it to the cradle (25) under the influence of a roller (46) positioned on a crank arm (39) carried by motor shaft (37). The force applied by the spring (32) may be varied by a spring adjustment mechanism (56) and the cradle (25) may be pivoted by an adjustment mechanism (61) to vary the trajectory of the ball (B) being struck.

25 Claims, 7 Drawing Sheets

APPARATUS FOR PROJECTING A BALL

TECHNICAL FIELD

This invention relates to an apparatus which projects a ball, in particular a resilient ball such as a volleyball, for use primarily as a practice and teaching aid. More particularly, this invention relates to such an apparatus which is energy efficient and in which the trajectory and extent of the ball projection can be readily adjusted.

BACKGROUND ART

Devices which automatically project balls to assist in the practice and teaching of sports participants are known in the art. For example, numerous types of baseball or tennis ball propelling machines exist so that the athlete can practice by himself to enhance his skills. Likewise, devices exist which can serve or set balls, such as volleyballs, so that the volleyball enthusiast can practice the skill, for example, of spiking the ball across the net.

While such volleyball propelling devices are adequate for their intended uses, such are not without their problems. Many such devices are overly heavy for their purposes requiring a large motor or power device to propel the balls through a range of distances and are thus quite inefficient. Moreover, most of these devices utilize a hopper-like ball feeding mechanism which can result in misfeeding or a clogging of the feeding of the balls to the discharge area. For those devices which have the ability to adjust the trajectory of the propelled ball, some utilize a cumbersome discharge chute to establish the trajectory. The friction generated by such chutes, as the balls pass therethrough, necessitates more input power, even for shorter projection distances, thereby compounding the inefficiency problem. Finally, not all of the known devices provide complete adjustability in, for example, propulsion force, trajectory or the like, and thus they limit the user to specific practice drills.

DISCLOSURE OF THE INVENTION

It is thus an object of the present invention to provide a device for projecting a ball, such as a volleyball, which is power efficient.

It is another object of the present invention to provide a device, as above, in which a motor is utilized to extend a spring to cock an impact arm, but the torque of the motor is maintained nearly constant even though the spring is being extended to a greater load.

It is a further object of the present invention to provide a device, as above, in which the tension of the spring is adjustable to change the distance that the ball will be propelled by the impact arm.

It is an additional object of the present invention to provide a device, as above, in which the balls are automatically fed to a cradle from which they are projected.

It is yet another object of the present invention to provide a device, as above, in which the trajectory of the ball being propelled from the cradle is adjustable without effecting the power requirements of the motor.

It is a still further object of the present invention to provide a device, as above, which includes a system to absorb the energy of the impact arm after the ball has been projected.

These and other objects of the present invention, which will become apparent from the description to follow, are accomplished by the improvements hereinafter described and claimed.

In general, a device for projecting a ball made in accordance with one aspect of the present invention includes an arm member which is pivoted in one direction by a motor. Power means, preferably in the form of a spring, pivots the arm member in the other direction to strike a ball being held by a pivotally mounted cradle. Means are provided to pivot the cradle to adjust the trajectory of the ball to be projected, and means are provided to adjust the power of the power means to thereby change the speed or force of the arm upon impact.

In accordance with another aspect of the present invention, the arm longitudinally extends from its first end where it is connected to the spring to its second, ball impact end, and is pivotally mounted therebetween. A ramp surface is mounted on the arm angularly to the longitudinal direction of the arm. The motor carries means to engage the ramp surface to first extend the spring and then disengage the ramp surface so that the arm pivots on a path under the influence of the spring. The cradle holds a ball in the path of the arm so that its second, impact end strikes the ball.

A preferred exemplary ball projecting device incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
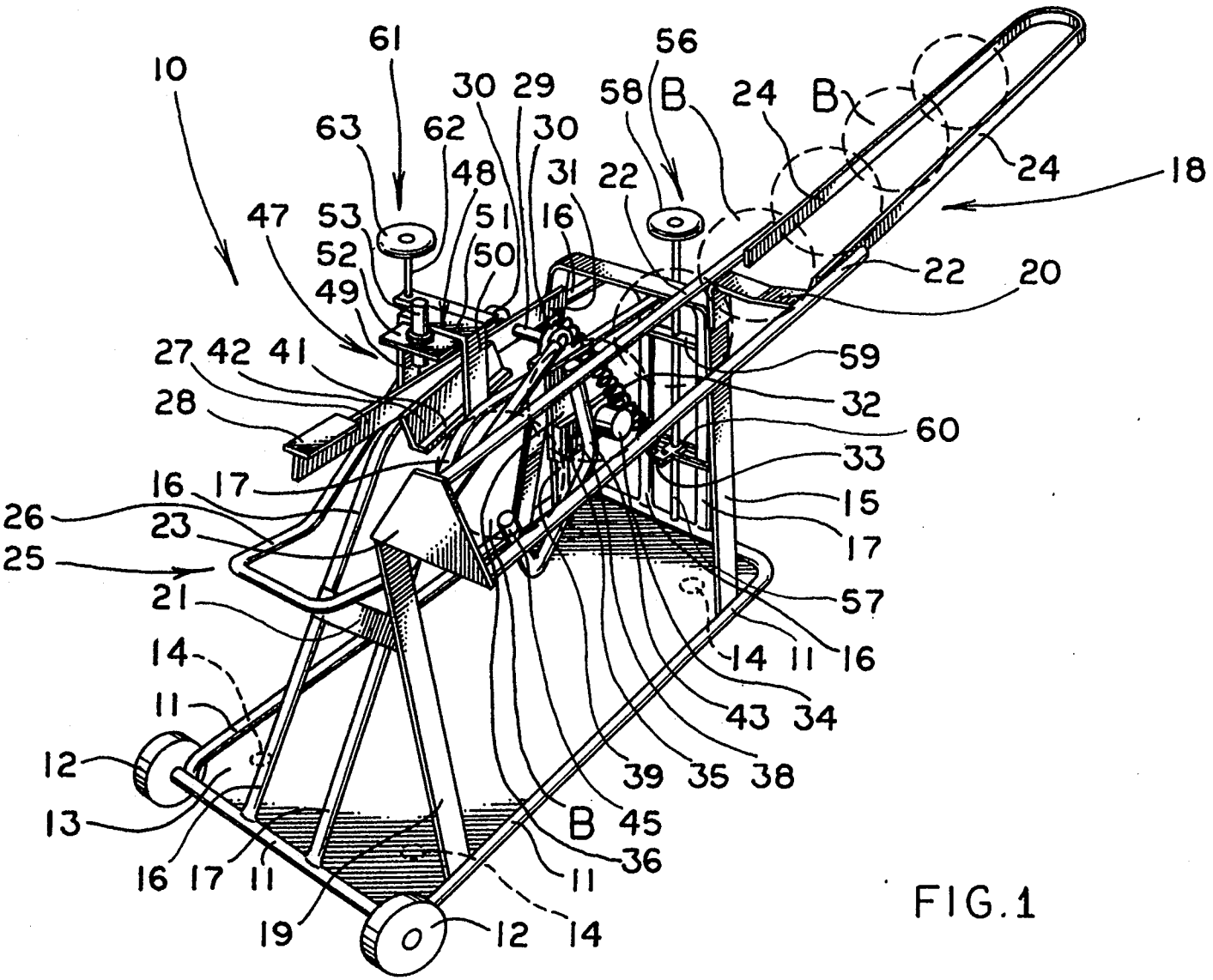
FIG. 1 is a somewhat schematic perspective view of a ball projecting machine made in accordance with the concepts of the present invention.

A machine for projecting a ball made in accordance with the concepts of the present invention is indicated generally by the numeral 10 and shown in FIG. 1 as including a generally rectangular tubular base frame 11 which can have wheels 12 positioned at at least one end thereof to render machine 10 mobile. A base plate 13 may be positioned within frame 11 to add rigidity, weight and stability to machine 10 and may carry energy absorbing bumper feet 14 on the bottom side thereof. Preferably, feet 14 are dimensioned so that wheels 12 will not touch the ground when machine 10 is in use. Thus, undesirable creeping of machine 10 is avoided, and any forces transmitted through the device will be silently absorbed by feet 14. When transporting of machine 10 is desired, merely lifting the back end opposite to wheels 12 will tip frame 11 sufficiently to allow wheels 12 to touch the ground. To facilitate such lifting, one or more handles (not shown) may be positioned on a U-shaped rear frame 15 which is located at the back of machine 10 and which extends upwardly from base frame 11 forming a rear arch thereover.

At the front end of machine 10, spaced tube frame members 16 and 17 extend angularly upwardly from base frame 11, and at approximately the height of rear frame 15, tube frame members 16 and 17 bend and extend generally horizontally where they may be attached to rear frame 15. Frame members 16 and 17 then turn downwardly and are attached to base frame 11 at the rear of machine 10. Base frame 11, rear frame 15 and tube frame members 16 and 17 thus form the basic support structure for all of the components of machine 10. A cover (not shown for clarity) may be provided to enclose all of such components.

A ball supply magazine, indicated generally by the numeral 18, is supported at the front of machine 10 by a bar 19 extending generally vertically upwardly from base frame 11 and at the rear of machine 10 by an arm 20 extending outwardly from rear frame 15. A frame member 21 extends across tube frame members 16 and 17 to engage bar 19 for further structural support.

Ball supply magazine 18 includes spaced apart tubular ball support rods 22 attached at the front end to a trapezoidal stop plate 23 carried by bar 19 and supported at the other end by arm 20. Rods 22 are designed to be spaced a distance dependent upon the size of the balls to be projected by machine 10. While machine 10 can be designed to project any type of ball, preferably the balls to be projected are of the inflatable type such as volleyballs B. Thus, as shown in FIG. 1, when machine 10 is utilized to project volleyballs B, rods 22 are spaced so as to provide a support surface for volleyballs B which may roll therealong toward stop plate 23 because rods 22 are sloped, being mounted higher on arm 20 than on bar 19. A U-shaped magazine extension 24, of any desired length, may be pivotally mounted to the rear ends of rods 22 to carry more volleyballs B, if desired. When machine 10 is not in use, extension 24 may be pivoted and folded onto rods 22 for facile storage.

In a manner to be hereinafter described, volleyballs B are transferred, one at a time, from magazine 18 to a generally U-shaped ball launching cradle 25 having spaced side arms 26 pivotally supported by tube frame members 16 and 17. An impact arm 27 is positioned so as to be receivable between cradle side arms 26 and has a ball striking plate 28 positioned at the end thereof adjacent to cradle 25. Arm 27 is shown in FIG. 1 generally in its neutral or unloaded position, and the cocking of arm 27, so that it may project a ball positioned on cradle 25, will now be described with particular reference to FIGS. 2–4.

Arm 27 is pivotal about an axis defined by a shaft 29 which is journaled for rotation in bearing blocks 30 carried by frame members 16 and 17. The end of arm 27 opposite to striking plate 28 is connected, as at 31, to one end of a conventional coil extension spring 32. The other end of spring 32 is connected, as by hook 33, at the rear of machine 10 as will hereinafter be described in more detail. A motor 34 having a gear box 35 is carried on a plate 36 affixed to frame member 17. Motor 34 turns a motor shaft 37, in a counterclockwise direction as viewed, for example, in FIG. 2, which carries a long crank arm 38 and a shorter crank arm 39. The outer end of crank arm 38 is provided with a roller 40 which is adapted to ride on a ramp 41 which can be formed by attaching an angle iron 42 to impact arm 27. As will hereinafter be described in more detail, for efficient operation it is important that ramp 41 is positioned at an angle to the longitudinal axis of arm 27 rather than, for example, parallel to arm 27. In this embodiment that angle is approximately fourteen degrees.

Figure 2:
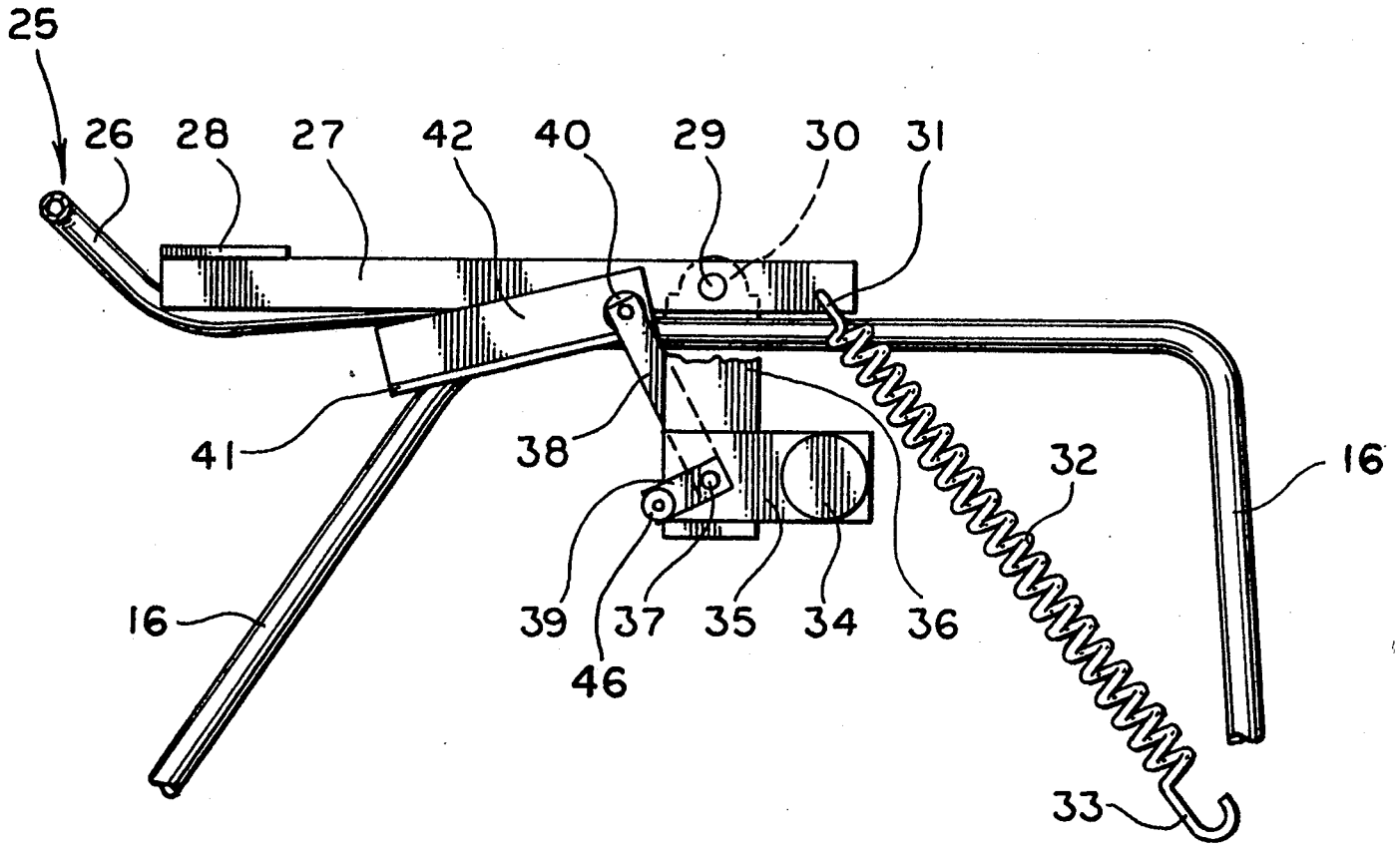
FIG. 2 is a fragmented, somewhat schematic view of a portion of the machine of FIG. 1 showing the initial stages of the cocking of the impact arm.
Figure 3:
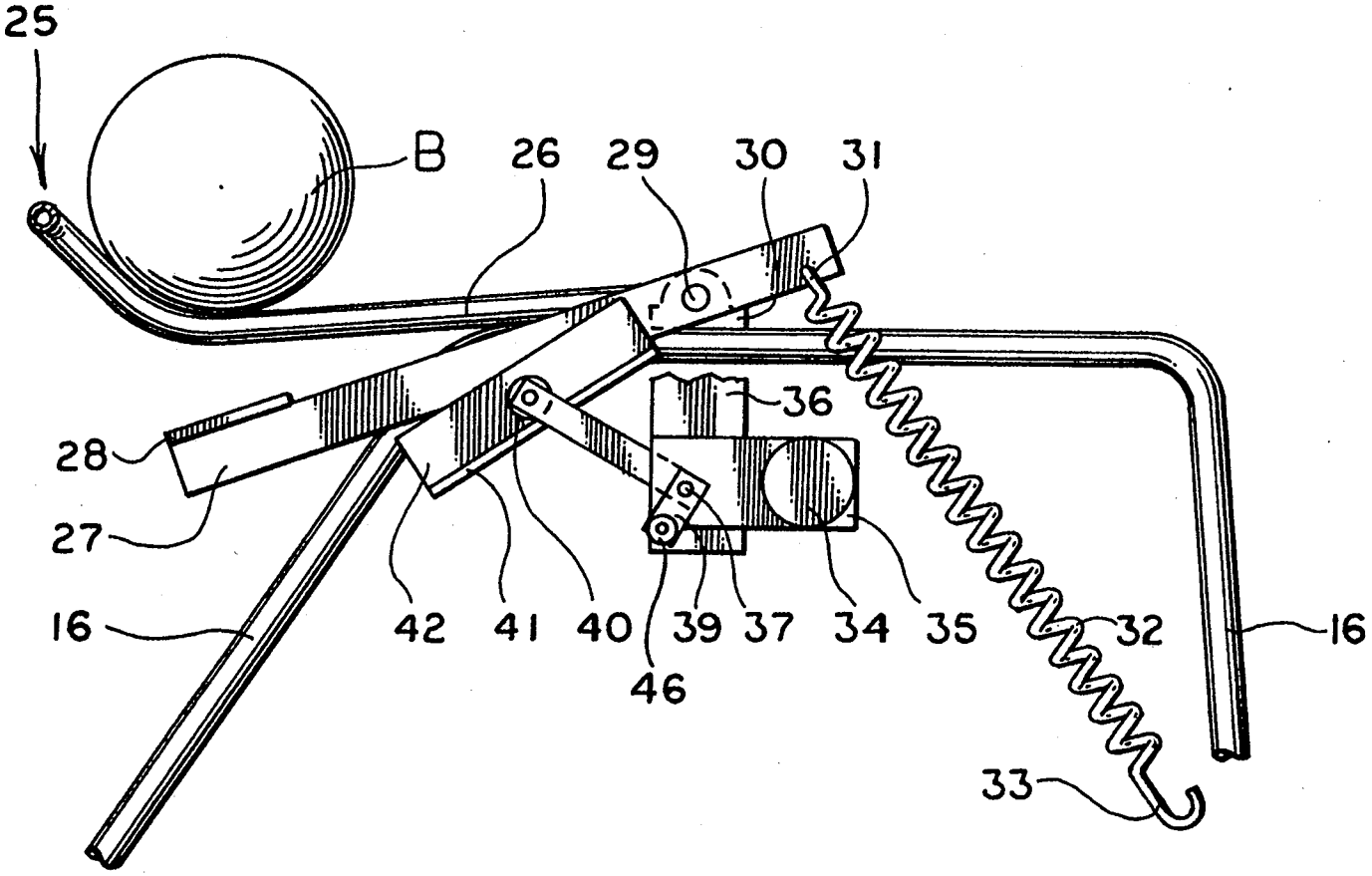
FIG. 3 is a view similar to FIG. 2 showing an intermediate stage of the cocking of the impact arm and thus sequentially follows FIG. 2 in the cocking movement.
Figure 7:
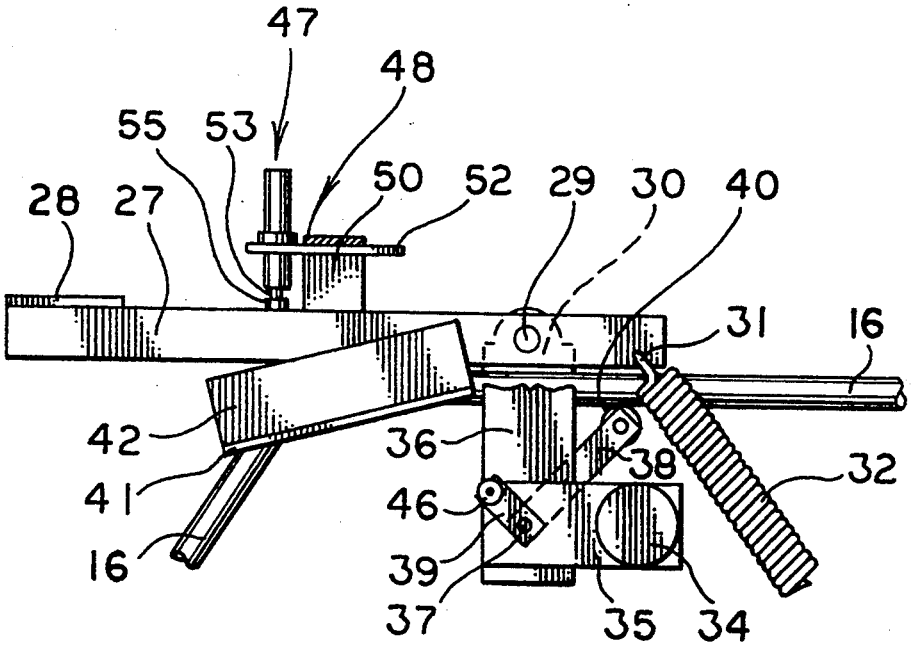
FIG. 7 is a fragmented, somewhat schematic view showing a portion of the machine which includes the mechanism by which the force of the impact arm is absorbed after a ball has been projected.

Prior to the cocking of arm 27, such as shown in FIG. 1, crank arm 38 is in a position, such as shown in FIG. 7, that is, roller 40 has not yet engaged ramp 41. Upon continued rotation of motor shaft 37, roller 40 is received on ramp 41 (FIG. 2). Continued rotation of shaft 37 causes roller 40 to move along ramp 41 which pulls arm 27 down, as shown in FIG. 3; that is, arm 27 is rotated on shaft 29. Such action, of course, stretches spring 32. As roller 40 reaches the end of ramp 41 (FIG. 4), the maximum cocking force and maximum desired extension of spring 32 is achieved, and upon continued rotation of shaft 37 and arm 38, roller 40 drops off the end of ramp 41 releasing the cocking force on arm 27 which is then driven by spring 32 on a path to strike a ball B positioned on cradle 25.

Figure 4:
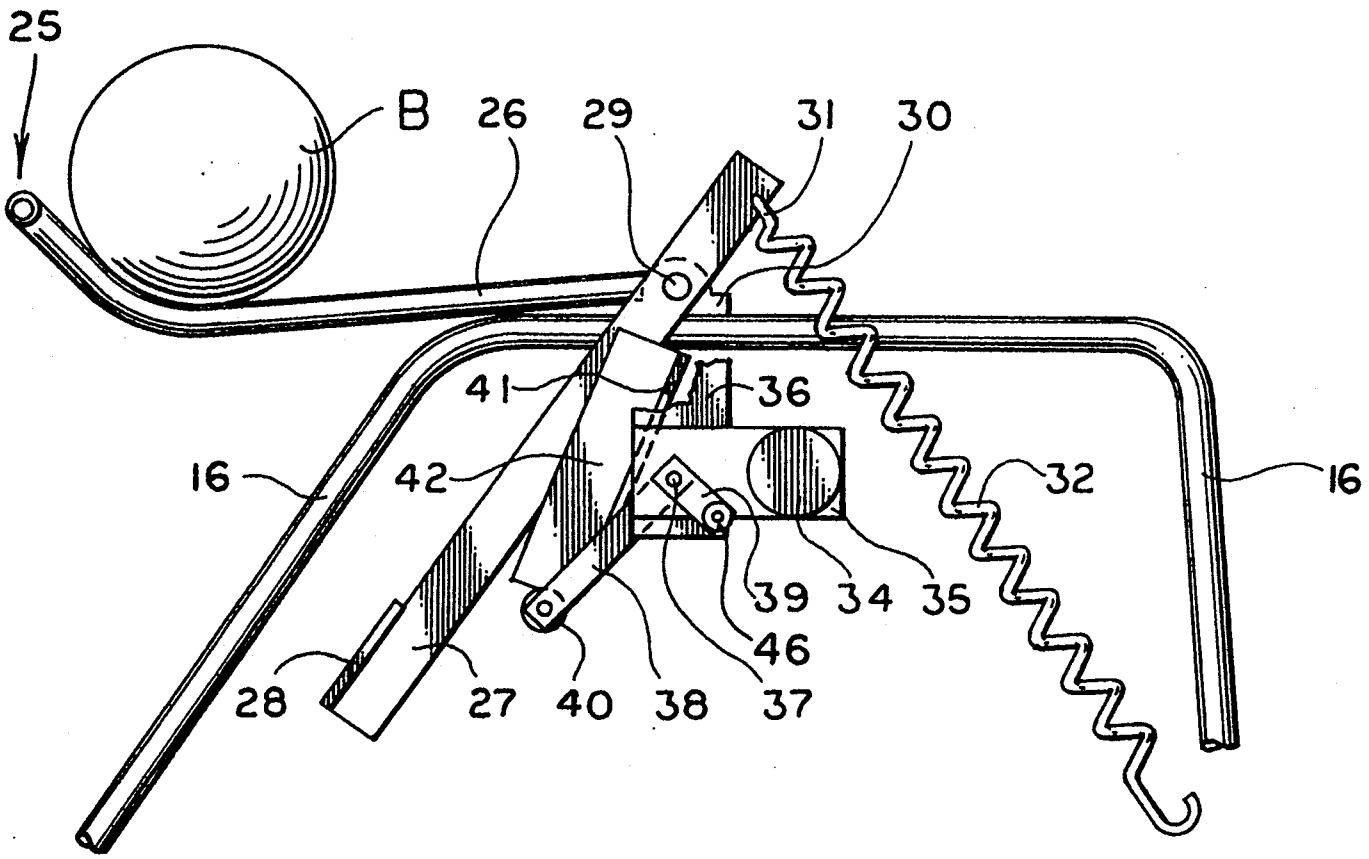
FIG. 4 is a view similar to FIGS. 2 and 3 showing the end of the cocking stage and thus sequentially follows FIG. 3.

The fact that ramp 41 is positioned angularly with respect to the longitudinal axis of arm 27 enables machine 10 to utilize a smaller output torque motor 34 to generate the force that is necessary to cock arm 27. That is, the angled ramp 41 maintains the motor load relatively constant throughout the cocking procedure even though spring 32 is being stretched. Selection of the precise angle of ramp 41 relative to arm 27 is dependent on variables such as the size of the motor 34, the length of arm 38, and the characteristics of spring 32. However, the key to determining the proper angle based on these variables is to select an angle where the output torque of the motor is the same (or nearly equal) at the time when roller 40 first engages ramp 41 (FIG. 2) as it is when roller 40 is about to disengage ramp 41 (FIG. 4). Motor 34 is thus operating at a generally constant torque throughout the time that arm 27 is being cocked and the energy is then released almost instantly.

The operation of motor 34 may be manually initiated, as by turning motor 34 on every time it is desired to strike a ball B, or it may be continually operated thereby projecting a ball B once every revolution of arm 38, or as would be well known to one skilled in the art, a conventional timer could be utilized to project balls at predetermined intervals.

Figure 5:
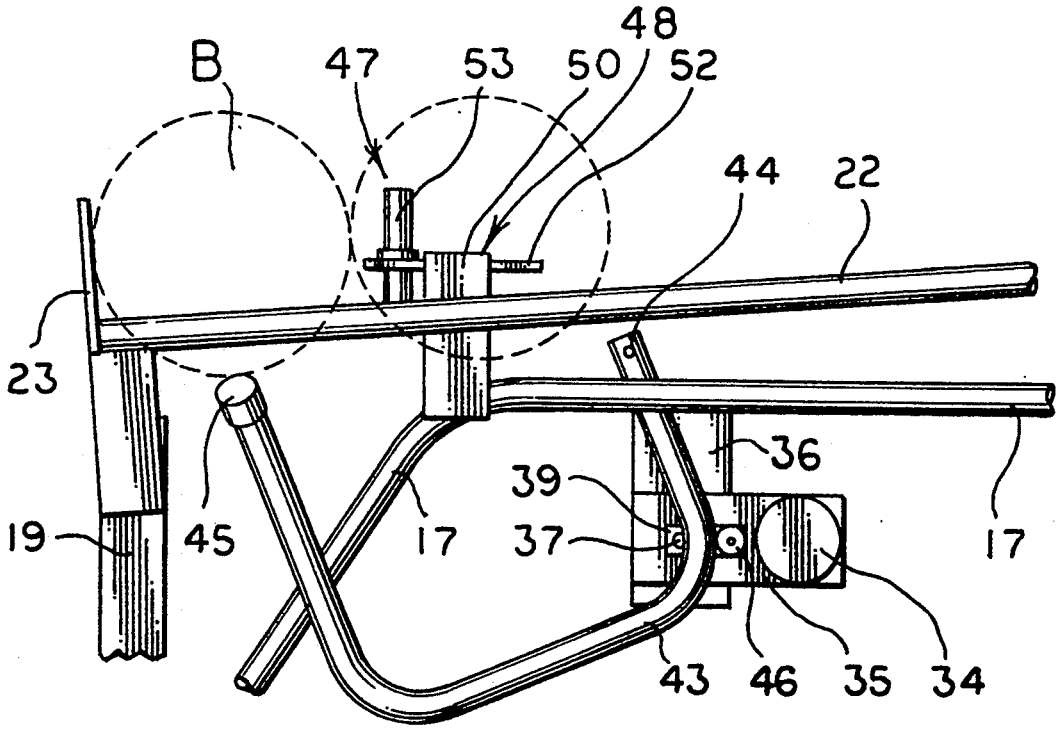
FIG. 5 is a fragmented, somewhat schematic view showing a portion of the machine including the details of the mechanism which loads a ball into the launching cradle.
Figure 6:
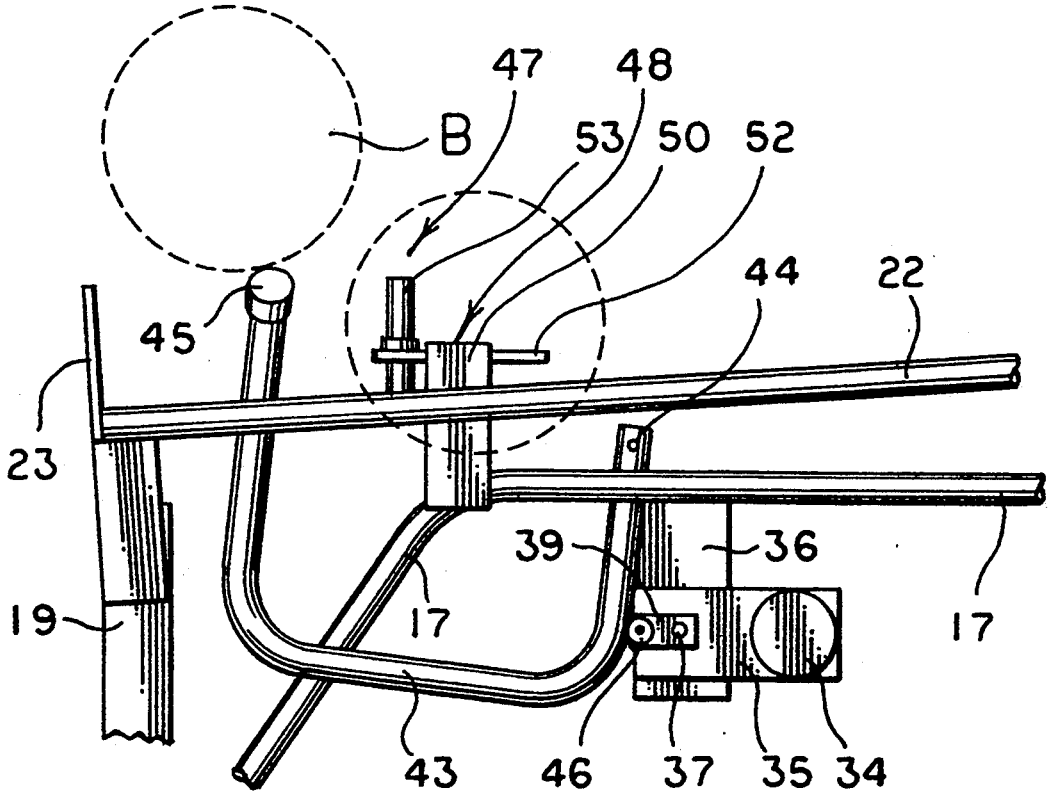
FIG. 6 is a view similar to FIG. 5 showing the mechanism in a position sequentially following that shown in FIG. 5.

Motor 34 is also utilized to feed balls B from magazine 18 one at a time during each cycle of motor shaft 37. The manner in which this is accomplished is best shown in FIGS. 5 and 6. A generally U-shaped or otherwise doglegged arm 43 is pivotally carried, as at 44, at one end by one side arm 26 of cradle 25. The other end of arm 43 may be provided with a pusher pad 45. Arm 43 rests at all times by gravity on a roller 46 mounted at the end of the shorter motor crank arm 39. As seen in FIG. 5, roller 46 is in a position such that arm 43 is located so that pad 45 is under, but not engaging a ball B in magazine 18. As arm 39 and roller 46 move to the FIG. 6 position, arm 39 has been moved such that pad 45 has moved upwardly between magazine rods 22 to engage the ball B which is positioned at the lowermost point of magazine 18, that is, adjacent to plate 23. Arm 43 is positioned and configured so that pad 45 will engage the ball somewhat off center—to the outside of machine 10—so that the ball will roll over the inner magazine rod 22 and onto cradle 25. Once the ball B adjacent to plate 23 is so removed from magazine 18, the remaining balls B in the magazine will roll down rods 22 so that the next ball is in position to be transferred to cradle 25 upon the next cycle of motor 34. In the overall operation, upon each revolution of motor shaft 37, crank arm 39 operates arm 43 at approximately the same time that roller 40 of crank arm 38 has begun to engage ramp 41 so that a ball B is positioned on cradle 25 just after impact arm 27 has been moved downwardly from the FIG. 1 position through cradle 25, that is, at a time between the FIG. 2 and FIG. 3 positions. This allows the ball to settle in cradle 25 by the time striking occurs.

With a ball thus positioned for impact, machine 10 goes through the completion of the cocking and impact cycle shown in FIGS. 3 and 4 as previously described. After impacting a ball B, arm 27 will continue to move upwardly and the remaining energy thereof is absorbed by a shock absorbing system generally indicated by the numeral 47 and shown in FIGS. 1 and 7. Shock absorbing system 47 includes an inverted U-shaped support bracket 48 having its branches 49 and 50 welded to, or otherwise carried by, frame members 16 and 17, respectively. The base support 51 of inverted U-shaped bracket 48 spans between branches 49 and 50 and carries a support plate 52. A shock absorber, which can be in the form of a hydraulic cylinder 53 having a piston rod 54, is carried by plate 52. A bumper 55 on impact arm 27 is adapted to engage rod 54 at the end of the impact stroke and cylinder 53 thereby absorbs the remaining energy of arm 27.

Figure 10:
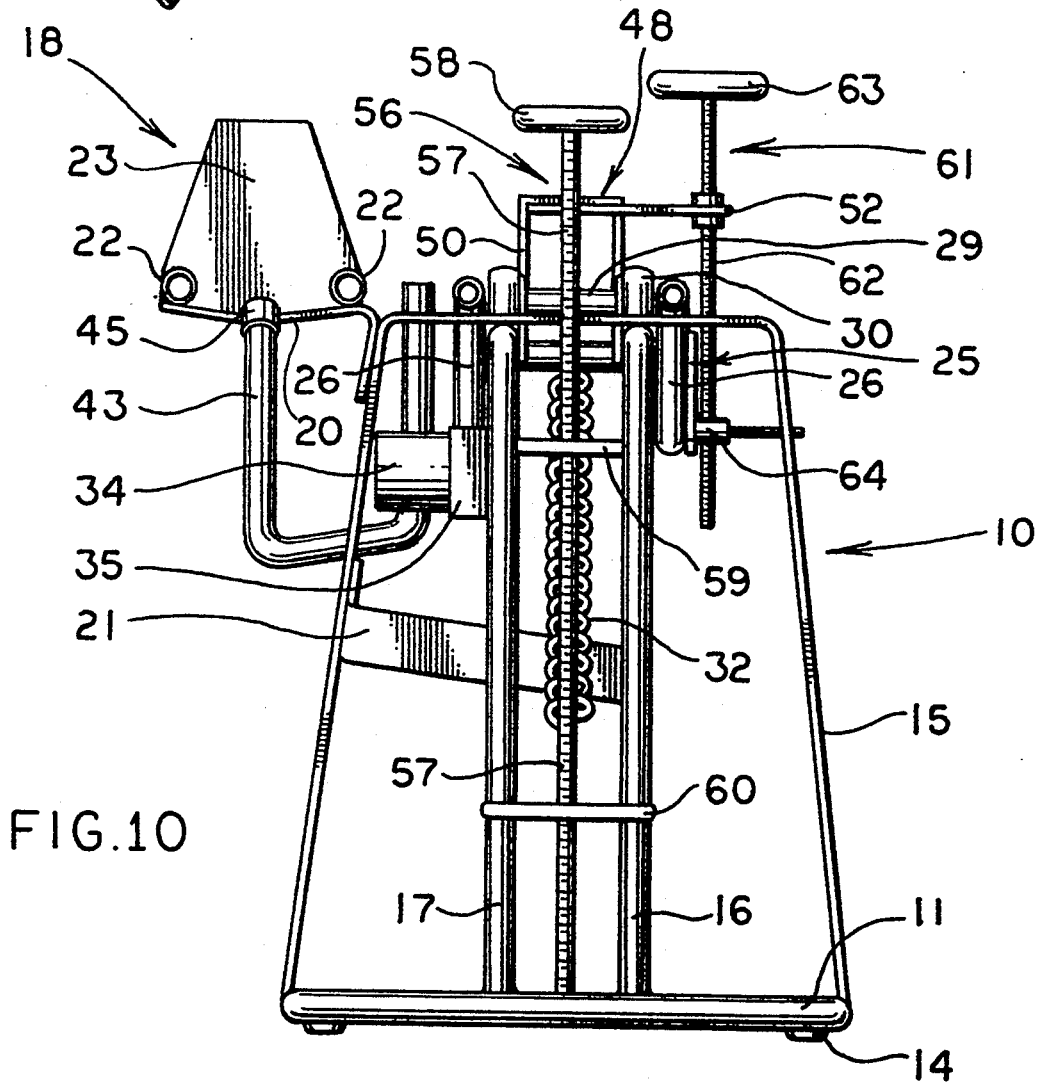
FIG. 10 is a fragmented, somewhat schematic view showing a portion of the machine which includes the mechanism by which the force to be applied by the spring may be adjusted.

The energy imparted to arm. 27 can be varied by a spring adjustment mechanism generally indicated by the numeral 56 and best shown in FIG. 10. Adjustment mechanism 56 includes a threaded shaft 57 having a handwheel 58 at the top thereof. Shaft 57 extends through an idler support bar 59 mounted between frame members 16 and 17. Shaft 57 is threadably engaged by spring anchor bar 60 to which hook 33 of spring 32 is attached. Rotation of handwheel 58 rotates shaft 57 which thus moves bar 60 upwardly or downwardly to decrease or increase, respectively, the tension of spring 32 thereby decreasing or increasing, respectively, the speed of and force to be applied by impact arm 27. A thermometer-like indicator (not shown) can be positioned adjacent to mechanism 56 so that the user can readily observe and set the amount of power to be exerted by spring 32.

Figure 8:
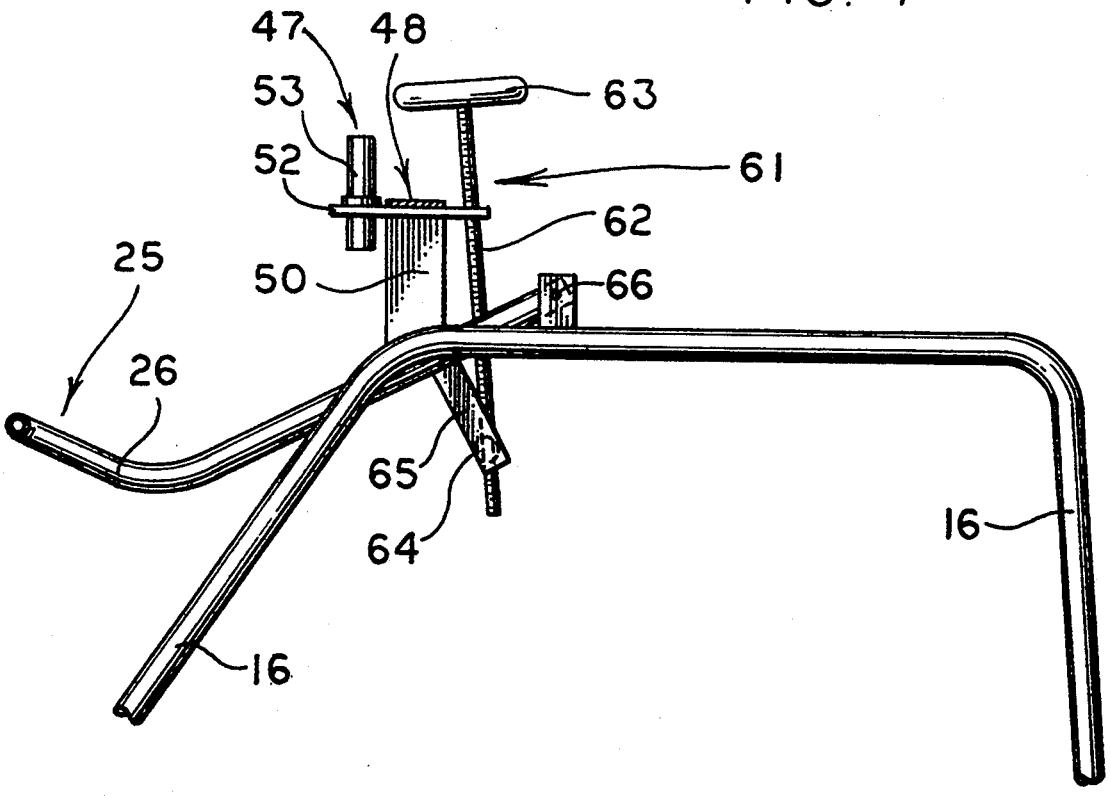
FIG. 8 is a fragmented, somewhat schematic view showing a portion of the machine which includes the mechanism by which the trajectory of a ball to be projected may be adjusted.
Figure 9:
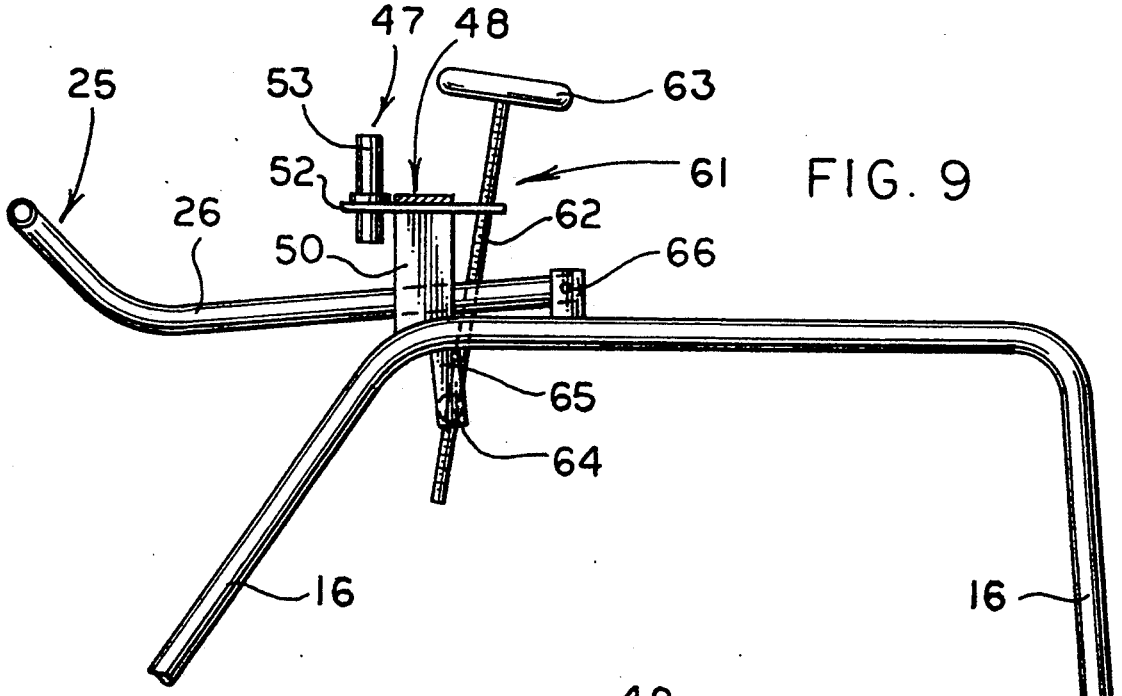
FIG. 9 is a view similar to FIG. 8 and showing an adjusted position of the launching cradle which provides a change in ball trajectory from that shown in FIG. 8.

Not only is the energy of the impact adjustable, but also the trajectory of the ball being projected can be varied by means of a trajectory adjustment mechanism indicated generally by the numeral 61 and best shown in FIGS. 8 and 9. Trajectory adjustment mechanism 61 includes a threaded shaft 62 having a handwheel 63 at the top thereof. Shaft 62 is shown as passing through an extension of plate 52 and is engaged by threaded bar stock 64 carried at one end of an arm 65, the other end of which is mounted to one arm 26 of cradle 25. Arms 26 of cradle 25 are pivotally connected, as at 66, to frame members 16 and 17 such that rotation of handwheel 63 pivots cradle 25, for example, from the position shown in FIG. 8 to the position shown in FIG. 9 where a ball would be projected more vertically than it would be with cradle 25 in the FIG. 8 position, because arm 27 would pivot further along its arcuate path of travel before striking ball B. Another thermometer-like indicator (not shown) can be positioned adjacent to mechanism 61 so that the user can readily observe and set the desired trajectory.

It should thus be evident that by means of the adjusting mechanisms just described, an essentially infinite range of ball projections can be accomplished. With spring adjustment assembly 56 set for maximum power, very high ball projections of a high trajectory, very long ball projections of a low trajectory, or any projection therebetween can be accomplished dependent on the setting of trajectory adjustment mechanism 61. With spring adjustment assembly 56 set for minimum power, low ball projections of a high trajectory, short ball projections of a low trajectory, or any projection therebetween can be accomplished, again dependent on the setting of trajectory adjustment mechanism 61. All of this is accomplished by the efficient utilization of the energy output of a motor, the torque output of which is constant throughout its working cycle. A ball projecting machine made in accordance with the concepts described herein thus accomplishes the objects of the present invention and otherwise substantially improves the art.

I claim:

1. Apparatus for projecting a ball comprising a pivotally mounted arm member, pivotally mounted cradle means for holding a ball to be projected, motor means to pivot said arm member in one direction, power means to pivot said arm member in the opposite direction to strike the ball, means to pivot said cradle means to vary the angular position of said cradle means relative to said arm member to thereby adjust the trajectory of the ball to be projected, and means to adjust said power means to change the speed of movement of said arm member in said opposite direction.

2. Apparatus according to claim 1 further comprising magazine means to hold a supply of balls to be projected.

3. Apparatus according to claim 2 further comprising means to increase the ball holding capacity of said magazine means.

4. Apparatus according to claim 2 further comprising means to feed a ball from said magazine means to said cradle means.

5. Apparatus according to claim 1 further comprising means to absorb the energy imparted to said arm member by said power means.

6. Apparatus according to claim 5 wherein said means to absorb includes a hydraulic cylinder positioned so as to engage said arm member after said arm member strikes a ball.

7. Apparatus according to claim 1 wherein said power means includes a spring connected at one end to one end of said arm member, said means to adjust said power means including a rotatable threaded shaft and a bar member movable on said threaded shaft, the other end of said spring being carried by said bar member so that upon rotation of said threaded shaft, said spring is selectively compressed or extended.

8. Apparatus for projecting a ball comprising a pivotally mounted arm member, pivotally mounted cradle means for holding a ball to be projected, motor means to pivot said arm member in one direction, power means to pivot said arm member in the opposite direction to strike the ball, means to pivot said cradle means to adjust the trajectory of the ball to be projected, means to adjust said power means to change the speed of movement of said arm member in said opposite direction, magazine means to hold a supply of balls to be projected, and means to feed a ball from said magazine means to said cradle means, said means to feed including a pusher arm, said motor means including a rotating shaft, a crank arm carried by said shaft, and a roller at the end of said crank arm, said roller engaging said pusher arm so that upon rotation of said shaft and said crank arm, said pusher arm transfers a ball from said magazine means to said cradle means.

9. Apparatus for projecting a ball comprising a pivotally mounted arm member; means forming a ramp positioned on said arm member; pivotally mounted cradle means for holding a ball to be projected; motor means to pivot said arm member in one direction, said motor means including a rotating shaft, a crank arm carried by said shaft, and a roller at the end of said crank arm, said roller engaging said means forming a ramp to pivot said arm member in said one direction; power means to pivot said arm member in the opposite direction to strike the ball; means to pivot said cradle means to adjust the trajectory of the ball to be projected; and means to adjust said power means to change the speed of movement of said arm member in said opposite direction.

10. Apparatus according to claim 9 wherein said means forming a ramp is positioned angularly to said arm member.

11. Apparatus for projecting a ball comprising a pivotally mounted arm member; pivotally mounted cradle means for holding a ball to be projected; motor means to pivot said arm member in one direction; power means to pivot said arm member in the opposite direction to strike the ball; means to pivot said cradle means to adjust the trajectory of the ball to be projected, said means to pivot said cradle means to adjust the trajectory of the ball including a rotatable threaded shaft, and means on said cradle means to receive said threaded shaft so that upon rotation of said threaded shaft, said cradle means is pivoted; and means to adjust said power means to change the speed of movement of said arm member in said opposite direction.

12. Apparatus for projecting a ball comprising an arm member longitudinally extending from a first end to a second end, said arm member being pivotally mounted on an axis between said ends, a spring attached to said first end of said arm member, a ramp surface on said arm member extending angularly to the longitudinal direction of said arm member, motor means to pivot said arm member, means carried by said motor means to first engage said ramp surface to extend said spring and then disengage said ramp surface so that said arm member pivots on a path under the influence of said spring, and cradle means for holding a ball in the path of said arm member so that said second end of said arm member can strike the ball.

13. Apparatus according to claim 12 wherein said motor means includes a rotating shaft and said means carried by said motor means includes a crank arm carried by said shaft, and roller means carried by said crank arm for engaging said ramp surface.

14. Apparatus according to claim 13 further comprising arm means for positioning a ball on said cradle means, a second crank arm carried by said shaft, and second roller means carried by said second crank arm to move said arm means to position a ball on said cradle while said roller means is engaging said ramp surface.

15. Apparatus according to claim 12 further comprising means in the path of said arm member to engage said arm member after it strikes the ball and to absorb the energy thereof.

16. Apparatus according to claim 12 further comprising means to adjust the influence of said spring on said arm member so that said arm member strikes the ball selectively with a greater or lesser force.

17. Apparatus according to claim 12 further comprising means to pivotally mount said cradle means, and means to adjust the trajectory of the ball to be struck by pivoting said cradle means on said means to pivotally mount.

18. Apparatus according to claim 12 further comprising magazine means to hold a supply of balls to be projected.

19. Apparatus according to claim 18 further comprising means to feed a ball from said magazine means to said cradle means.

20. Apparatus according to claim 19 wherein said means to feed includes a pusher arm, said motor means including a rotating shaft, a crank arm carried by said shaft, and a roller at the end of said crank arm, said roller engaging said pusher arm so that upon rotation of said shaft and said crank arm, said pusher arm transfers a ball from said magazine means to said cradle means.

21. Apparatus for projecting a ball comprising an arm member longitudinally extending from a first end to a second end, said arm member being pivotally mounted on an axis between said ends, a spring attached to said first end of said arm member, a ramp surface on said arm member extending angularly to the longitudinal direction of said arm member, motor means to first engage said ramp surface to extend said spring and then disengage said ramp surface so that said arm member pivots on a path under the influence of said spring, means to adjust said spring to change the extent of its influence on said arm member, cradle means holding a ball in the path of said arm member so that said second end of said arm member strikes the ball, and means to pivot said cradle means to adjust the trajectory of the ball to be projected.

22. Apparatus according to claim 21 further comprising means in the path of said arm member to engage said arm member after it strikes the ball and absorb the energy thereof.

23. Apparatus according to claim 21 wherein said motor means includes a rotating shaft, a crank arm carried by said shaft, and roller means carried by said crank arm for engaging said ramp surface.

24. Apparatus according to claim 23 further comprising magazine means to hold a supply of balls to be projected, and means to feed a ball from said magazine means to said cradle means.

25. Apparatus according to claim 21 wherein said means to feed includes a pivotal pusher arm, a second crank arm carried by said shaft, and second roller means carried by said second crank arm to pivot said pusher arm so that said pusher arm engages a ball in said magazine means and transfers it to said cradle means.

* * * * *